US011725568B2

(12) United States Patent
Röhr et al.

(10) Patent No.: US 11,725,568 B2
(45) Date of Patent: Aug. 15, 2023

(54) CONNECTION UNIT

(71) Applicant: Purem GmbH, Neunkirchen (DE)

(72) Inventors: Benjamin Röhr, Esslingen am Neckar (DE); Elke Preisser, Neuhausen (DE)

(73) Assignee: PUREM GMBH, Neunkirchen (DE)

( * ) Notice: Subject to any disclaimer, the term of this patent is extended or adjusted under 35 U.S.C. 154(b) by 231 days.

(21) Appl. No.: 16/952,778

(22) Filed: Nov. 19, 2020

(65) Prior Publication Data

US 2021/0156293 A1 May 27, 2021

(30) Foreign Application Priority Data

Nov. 26, 2019 (DE) ..... 10 2019 131 891.2

(51) Int. Cl.
*F01N 13/18* (2010.01)

(52) U.S. Cl.
CPC ..... *F01N 13/1838* (2013.01); *F01N 13/1805* (2013.01); *F01N 2450/20* (2013.01); *F01N 2450/22* (2013.01)

(58) Field of Classification Search
CPC .. F01N 13/08; F01N 13/1805; F01N 13/1838; F01N 13/1855; F01N 2450/20; F01N 2450/22
See application file for complete search history.

(56) References Cited

U.S. PATENT DOCUMENTS

| | | | | |
|---|---|---|---|---|
| 11,268,431 | B2 * | 3/2022 | Motoyama | F01N 3/28 |
| 2003/0102666 | A1 * | 6/2003 | Huber | F01N 13/1805 285/47 |
| 2005/0127670 | A1 * | 6/2005 | Huber | F16L 27/11 285/368 |
| 2015/0260077 | A1 * | 9/2015 | Steigert | F01N 13/1827 60/323 |

FOREIGN PATENT DOCUMENTS

| | | | |
|---|---|---|---|
| CN | 1462333 | A | 12/2003 |
| CN | 104912639 | A | 9/2015 |
| CN | 109209594 | A | 1/2019 |
| EP | 0759502 | A1 | 2/1997 |
| JP | H03189317 | A | 8/1991 |
| JP | 2000136722 | A | 5/2000 |

* cited by examiner

*Primary Examiner* — Anthony Ayala Delgado
(74) *Attorney, Agent, or Firm* — McGlew and Tuttle, P.C.

(57) ABSTRACT

A connection unit for connecting two exhaust gas-carrying assembly units of an exhaust system of an internal combustion engine, includes a ring washer-shape connection element (26) with a connection side (42), which is to be positioned to face a counter-connection element (24) to be connected to the connection element (26) or/and in contact with the counter-connection element (24). A passage opening (28), bordered by an inner circumferential surface (36) of the connection element (26), receives a connection pipe (30), which is inserted into the passage opening (28) and extends in the direction of a pipe longitudinal axis (L). The connection pipe (30) is connected to the connection element (26) in the area of the inner circumferential surface (36) by welding, or/and the connection pipe (30) projects with a centering section (40) on the connection side (42) of the connection element (26).

18 Claims, 1 Drawing Sheet

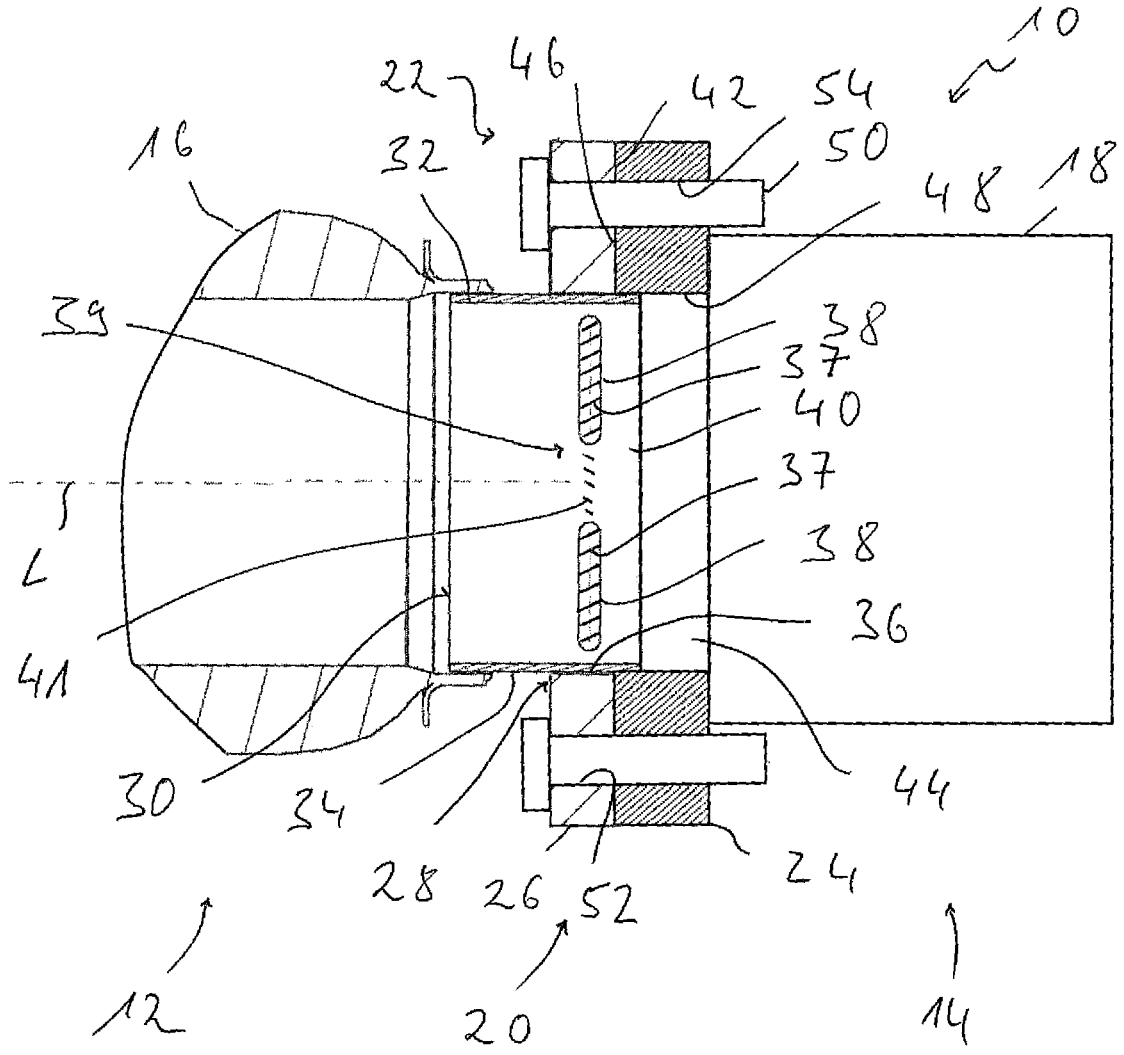
10
22
46
42
54
50
16
32
48
18
39
38
37
40
37
38
L
36
41
30
34
44
28
26
52
24
12
20
14

CONNECTION UNIT

CROSS REFERENCE TO RELATED APPLICATIONS

This application claims the benefit of priority under 35 U.S.C. § 119 of German Application 10 2019 131 891.2, filed Nov. 26, 2019, the entire contents of which are incorporated herein by reference.

TECHNICAL FIELD

The present invention pertains to a connection unit for connecting two exhaust gas-carrying assembly units of an exhaust system of an internal combustion engine, comprising a ring washer-like (washer-shape) connection element with a connection side to be positioned such that it faces a counter-connection element to be connected to the connection element or/and is in contact with same and with a passage opening bordered by an inner circumferential surface of the connection element as well as to a connection pipe, which is inserted into the passage opening and extends in the direction of a pipe longitudinal axis.

TECHNICAL BACKGROUND

Such connection units are used in exhaust systems of internal combustion engines in vehicles in order to establish a permanent and essentially exhaust gas-tight connection between different exhaust gas-carrying assembly units. In particular, such connection units are to be established in the transition area between a so-called "hot end," i.e., an area of an exhaust system, which area carries very hot exhaust gases close to an internal combustion engine, and a "cold end," i.e., an area of an exhaust system carrying already somewhat cooled exhaust gases.

SUMMARY

An object of the present invention is to provide a connection unit for connecting two exhaust gas-carrying assembly units of an exhaust system of an internal combustion engine, which can be mounted in a simple manner and meets the requirements imposed on exhaust gas tightness.

This object is accomplished according to the present invention by a connection unit for connecting two exhaust gas-carrying assembly units of an exhaust system of an internal combustion engine, comprising: a ring washer-shape connection element with a connection side to be positioned such that it faces a counter-connection element to be connected to the connection element or/and is in contact with same and with a passage opening bordered by an inner circumferential surface of the connection element and a connection pipe, which is inserted into the passage opening and extends in the direction of a pipe longitudinal axis.

The connection unit according to the present invention is characterized in that the connection pipe is connected to the connection element in the area of the inner circumferential surface by welding, or/and that the connection pipe projects with a centering section on the connection side of the connection element.

Different advantageous aspects are embodied in this connection unit. On the one hand, the connection of the connection element to the connection pipe in the area of the inner circumferential surface of the connection pipe guarantees that deformations especially of the connection element can be avoided to the greatest extent possible when the welded connection is produced. Very good gastightness is thus achieved when a connection is produced between the connection element and a counter-connection element. The aspect of providing a centering section at the connection unit facilitates the assembly of an exhaust system due to the centering function introduced by means of a centering section in relation to a counter-connection element.

In order to make it possible to produce the welded connection between the connection pipe and the connection element at the inner circumferential surface, it is proposed that the connection pipe have a weld opening passing completely through a pipe wall of the connection pipe in its length area axially overlapped by the inner circumferential surface, and that the connection pipe be connected to the connection element by a weld seam formed in the at least one weld opening.

In order to make it possible to provide such a welded connection over the largest possible circumferential area, the connection pipe may have a plurality of weld openings following one another around the longitudinal axis of the pipe in the circumferential direction.

In order to make it possible in such an embodiment to provide a gastight closure between the connection pipe and the connection element in circumferential areas between weld openings following one another directly in circumferential areas as well, it is proposed that a weld seam connecting the weld seams formed in these weld openings be produced in the area of at least one and preferably each web formed between two weld openings following one another directly in the circumferential direction.

Further, it is advantageous if at least one and preferably each weld opening is elongated in the circumferential direction about the pipe longitudinal axis. It is advantageous for producing a stable, but nevertheless gastight connection if a circumferential distance of weld openings following one another directly in the circumferential direction about the pipe longitudinal axis is in the range of 2 mm to 6 mm, or/and if an axial width of at least one and preferably each weld opening is in the range of 2 mm to 3 mm.

The present invention further pertains to a connection assembly unit for connecting two exhaust gas-carrying assembly units of an exhaust system of an internal combustion engine, comprising a connection unit with the above-described configuration according to the present invention and a ring washer-shape counter-connection element to be positioned with a counter-connection side facing the connection element of the connection unit or/and being in contact therewith, wherein a centering opening corresponding to the passage opening is provided in the counter-connection element.

In order to make it possible to provide a permanent connection between the connection element and the counter-connection element, the connection assembly unit may comprise at least one connection member for permanently connecting the connection element to the counter-connection element.

It is proposed for a connection that can be prepared in an especially simple manner but is nevertheless stable that the at least one connection member comprise a connection bolt passing through the connection element or/and the counter-connection element.

The centering function can be provided in an especially efficient manner by the passage opening and the centering opening being essentially congruent with one another when the counter-connection element is connected to the connection element. Congruent means in the sense of the present invention that the two openings are provided and arranged with equal opening cross-sectional geometry, equal opening cross-sectional size and, concerning the pipe longitudinal axis, with equal radial positioning.

To center the connection element in relation to the counter-connection element, the centering section of the connection pipe can mesh with the centering opening when the counter-connection element is connected to the connection element.

The present invention further pertains to an exhaust system, comprising a connection assembly unit configured according to the present invention, wherein a first exhaust gas-carrying assembly unit is connected to the connection pipe and a second exhaust gas-carrying assembly unit is connected to the counter-connection element.

The present invention will be described in detail below with reference to the attached FIGURE. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a partial longitudinal sectional view of an exhaust system for an internal combustion engine in a vehicle.

DESCRIPTION OF PREFERRED EMBODIMENTS

Referring to the drawings, FIG. 1 shows a detail of an exhaust system generally designated by 10 for an internal combustion engine of a vehicle. FIG. 1 shows, in particular, the transition between a so-called "hot end" 12 and a so-called "cold end" 14 of the exhaust system 10. Two, for example, tubular exhaust gas-carrying assembly units 16, 18 of the exhaust system 10 are connected to one another in this area by a connection assembly unit 20.

The connection assembly unit 20 comprises a connection unit 22 preferably connected to the "hot end" 12, i.e., the tubular assembly unit 16, and a ring washer-shape counter-connection element 24, which is connected to the connection unit 22 in the manner described below and is connected to the "cold end" 14 or to the assembly unit 18.

The connection unit 22 comprises a connection element 26 to be connected to the counter-connection element 24. This connection element 26 also has a ring washer-shape configuration and has a, for example, circularly shaped passage opening 28. A preferably essentially cylindrically shaped connection pipe 30 extending in the direction of a pipe longitudinal axis L is inserted into the passage opening 28. The connection pipe 30 is coordinated with an outer diameter of its pipe wall 32 with the internal diameter of the passage opening 28 such that when the connection pipe 30 is inserted into the passage opening 28, said connection pipe is received in the passage opening 28 essentially without play. In the length area axially overlapped by the inner circumferential surface 36, the connection pipe 30 has in the example shown a plurality of weld openings 38, which preferably have an elongated hole-like configuration and follow one another in the circumferential direction about the longitudinal axis L. These weld openings 38 pass through the pipe wall 32 of the connection pipe 30, so that the inner circumferential surface 36 is inwardly exposed, i.e., is not covered, basically in the area of the weld openings 38 when the connection pipe 30 is inserted into the passage opening 28.

To establish a permanent connection between the connection pipe 30 and the connection element 26, a weld seam 37, which preferably fills the weld openings 38 essentially completely and thus establishes a connection in substance of the connection pipe 30 to the connection element 26, is formed in the area of each of the weld openings 38. A connection of the connection element 26 in substance to the connection pipe 30, which connection is nearly completely continuous in the circumferential direction and is thus essentially gastight, is guaranteed by these weld seams 37 in relation to the inner circumferential surface 36 of the connection element 26. In order to make it possible to obtain a gas-tight connection between the connection pipe 30 and the connection element 26 in the area of the webs 39 formed between weld openings 38 following one another directly in the circumferential direction, the weld seams 37 formed, for example, by tungsten-inert gas welding or arc welding in the weld openings 38 can be led over the webs 39 in the circumferential direction in order to form weld seams 41 there as well. The weld seams 41 produced in the area of these webs 39 along the inner circumferential surface of the connection pipe 30 also lead to a connection in substance between the connection pipe 30 on the outer circumferential surface 34 thereof and the connection element 26 on the inner circumferential surface 36 thereof due to the introduction of heat occurring during the production of these weld seams. To produce such a weld seam, which is completely free from interruptions, in the circumferential direction between the connection pipe 30 and the connection element 26, it is advantageous if the webs 39 have a length of about 2 mm to 6 mm in the circumferential direction. It is also advantageous if the weld openings 38 have an axial width, i.e., an extension in the direction of the pipe longitudinal axis L, in the range of 2 mm to 3 mm.

The connection pipe 30 projects with a centering section 40 over the connection element 26 on a connection side 42 to be positioned facing the counter-connection element 24. Corresponding to the passage opening 28 of the connection element 26, a centering opening 44 is formed in the counter-connection element 24. When the counter-connection element 24 is in contact with a counter-connection side 46 on the connection side 42 of the connection element 26, the centering element 40 meshes with the centering opening 44 and thus guarantees a defined positioning of the counter-connection element 24 in relation to the connection element 26. Since the passage opening 28 and the centering opening 44 are essentially congruent when the connection element 26 and the counter-connection element 24 are in contact with one another, i.e., they continue one another essentially without a step in relation to the pipe longitudinal axis A based on equal cross-sectional geometry, equal cross-sectional dimension and equal positioning, the connection pipe 30 meshes with the centering section 40 with the centering opening 44 such that the outer circumferential surface 34 of the connection pipe 30 can come into contact in the area of the centering section 40 with an inner circumferential surface 48 of the counter-connection element 24, which said inner circumferential surface 48 borders the centering opening 44, so that an essentially gastight connection will develop between the connection pipe 30 and the counter-connection element 24 in this area as well.

To establish a permanent connection between the connection element 26 and the counter-connection element 24, a plurality of connection members 50 preferably configured as bolts are provided. These may pass, for example, through connection bolt openings 52 provided in the connection element 26 and may also pass through connection bolt openings 52 provided in the counter-connection element 24, so that a permanent holding together can be established at the ends projecting over the counter-connection element 24, for example, by attaching nuts or the like. As an alternative, the connection member openings 54 may be configured in the counter-connection element 24 as internally threaded openings, into which the connection members 50 can be screwed to establish a permanent connection.

With its connection side 42 or with an essentially flat surface provided there, the connection element 26 is pressed by the connection members 50 against the counter-connection side 46 or against a surface of the counter-connection element 24, which surface is provided there, so that an essentially gastight connection is achieved in this area as well. This connection can be supported by positioning a sealing element between the connection side 42 and the counter-connection side 46. Since the welding takes place in the area of the inner circumferential surface 36 of the connection element 26 during the connection of the connection pipe 30 to the connection element 26, a deformation of the connection element 26, which is induced by the heating occurring during the welding, is practically ruled out. This ensures that this connection element 26 is produced with high precision in the area of its connection side 42 as well and a gastight connection can thus be guaranteed in a mutual contact with the counter-connection element 24.

While specific embodiments of the invention have been shown and described in detail to illustrate the application of the principles of the invention, it will be understood that the invention may be embodied otherwise without departing from such principles.

What is claimed is:

1. A connection unit for connecting two exhaust gas-carrying assembly units of an exhaust system of an internal combustion engine, the connection unit comprising:

a ring washer-shape connection element with a connection side to be positioned facing a counter-connection element to be connected to the connection element with the connection element in contact with the counter-connection element and with a passage opening bordered by a connection element inner circumferential surface; and a connection pipe inserted into the passage opening and extending in a direction of a pipe longitudinal axis, wherein:

the connection pipe is connected to the connection element in an area of the connection element inner circumferential surface by welding;

the connection pipe has at least one weld opening passing completely through a pipe wall of the connection pipe in a length area axially overlapped by the connection element inner circumferential surface; and the connection pipe is connected to the connection element by a weld seam formed in the at least one weld opening.

2. The connection unit in accordance with claim 1, wherein the connection pipe projects with a centering section on the connection side of the connection element.

3. The connection unit in accordance with claim 1, wherein the connection pipe has a plurality of weld openings following one another in the circumferential direction about the pipe longitudinal axis.

4. The connection unit in accordance with claim 3, wherein a weld seam connecting weld seams formed in the weld openings in the circumferential direction is formed in the area of at least one web formed between two said weld openings following each other directly in the circumferential direction.

5. The connection unit in accordance with claim 1, wherein:

the at least one weld opening is elongated in the circumferential direction about the pipe longitudinal axis; or a circumferential distance of weld openings, of the at least one weld opening, following one another directly in the circumferential direction about the pipe longitudinal axis is in the range of 2 mm to 6 mm; or an axial width of the at least one weld opening is in the range of 2 mm to 3 mm; or any combination of the at least one weld opening is elongated in the circumferential direction about the pipe longitudinal axis, and a circumferential distance of weld openings, of the at least one weld opening, following one another directly in the circumferential direction about the pipe longitudinal axis is in the range of 2 mm to 6 mm, and an axial width of the at least one weld opening is in the range of 2 mm to 3 mm.

6. A connection assembly unit for connecting two exhaust gas-carrying assembly units of an exhaust system of an internal combustion engine, the connection assembly unit comprising:

a counter-connection element with a centering opening;

a connection unit comprising:

a ring washer-shape connection element with a connection side positioned facing the counter-connection element or in contact with the counter-connection element and with a passage opening bordered by a connection element inner circumferential surface, the centering opening of the counter-connection element corresponding to the passage opening provided in the connection element; and a connection pipe inserted into the passage opening and extending in a direction of a pipe longitudinal axis, wherein:

the connection pipe is connected to the connection element in an area of the connection element inner circumferential surface by welding;

the connection pipe has at least one weld opening passing completely through a pipe wall of the connection pipe in a length area axially overlapped by the connection element inner circumferential surface; and the connection pipe is connected to the connection element by a weld seam formed in the at least one weld opening.

7. The connection assembly unit in accordance with claim 6, further comprising at least one connection member for fixedly connecting the connection element to the counter-connection element.

8. The connection assembly unit in accordance with claim 7, wherein:

the at least one connection member comprises a connection bolt passing through the connection element; or the at least one connection member comprises a connection bolt passing through the counter-connection element; or the at least one connection member comprises a connection bolt passing through the connection element and passing through the counter-connection element.

9. The connection assembly unit in accordance with claim 6, wherein, with the counter-connection element connected to the connection element, the passage opening and the centering opening are essentially congruent with one another.

10. The connection assembly unit in accordance with claim 6, wherein the connection pipe projects with a centering section on the connection side of the connection element and, with the counter-connection element connected to the connection element, the centering section of the connection pipe meshes with the centering opening.

11. The connection assembly unit in accordance with claim 6, wherein the connection pipe has a plurality of weld openings following one another in the circumferential direction about the pipe longitudinal axis.

12. The connection assembly unit in accordance with claim 11, wherein a weld seam connecting weld seams formed in the weld openings in the circumferential direction is formed in the area of at least one web formed between two said weld openings following each other directly in the circumferential direction.

13. An exhaust system comprising:

a connection assembly unit comprising:

a counter-connection element with a centering opening;

a connection unit comprising:

a ring washer-shape connection element with a connection side positioned facing the counter-connection element or in contact with the counter-connection element and with a passage opening bordered by a connection element inner circumferential surface, the centering opening of the counter-connection element corresponding to the passage opening provided in the connection element; and a connection pipe inserted into the passage opening and extending in a direction of a pipe longitudinal axis, wherein:

the connection pipe is connected to the connection element in an area of the connection element inner circumferential surface by welding;

the connection pipe has at least one weld opening passing completely through a pipe wall of the connection pipe in a length area axially overlapped by the connection element inner circumferential surface; and the connection pipe is connected to the connection element by a weld seam formed in the at least one weld opening;

a first exhaust gas-carrying assembly unit connected to the connection pipe; and a second exhaust gas-carrying assembly unit connected to the counter-connection element.

14. The exhaust system in accordance with claim 13, wherein the connection pipe has a plurality of weld openings following one another in the circumferential direction about the pipe longitudinal axis.

15. The exhaust system in accordance with claim 14, wherein a weld seam connecting weld seams formed in the weld openings in the circumferential direction is formed in the area of at least one web formed between two said weld openings following each other directly in the circumferential direction.

16. The exhaust system in accordance with claim 13, further comprising at least one connection member for fixedly connecting the connection element to the counter-connection element, wherein the at least one connection member passes through the connection element, or the at least one connection member passes through the counter-connection element, or the at least one connection member passes through the connection element and passes through the counter-connection element.

17. The exhaust system in accordance with claim 13, wherein, with the counter-connection element connected to the connection element, the passage opening and the centering opening are essentially congruent with one another.

18. The exhaust system in accordance with claim 13, wherein the connection pipe projects with a centering section on the connection side of the connection element and, with the counter-connection element connected to the connection element, the centering section of the connection pipe meshes with the centering opening.

* * * * *